US005543908A

United States Patent [19]

Suzuki

[11] Patent Number: 5,543,908

[45] Date of Patent: Aug. 6, 1996

[54] IMAGE FORMING APPARATUS HAVING ENDLESS RECORDING MATERIAL CARRYING MEMBER

[75] Inventor: Hajime Suzuki, Yokohama, Japan

[73] Assignee: Canon Kabushiki Kaisha, Tokyo, Japan

[21] Appl. No.: 419,744

[22] Filed: Apr. 10, 1995

Related U.S. Application Data

[63] Continuation of Ser. No. 180,466, Jan. 12, 1994, abandoned, which is a continuation of Ser. No. 833,675, Feb. 11, 1992, abandoned.

[30] Foreign Application Priority Data

Feb. 12, 1991 [JP] Japan ..... 3-018768

[51] Int. Cl.[6] ..... G03G 21/00

[52] U.S. Cl. ..... 355/315

[58] Field of Search ..... 355/212, 271, 355/308, 315

[56] References Cited

U.S. PATENT DOCUMENTS

| | | | |
|---|---|---|---|
| 3,797,930 | 3/1974 | Tanaka et al. | 355/212 X |
| 4,062,631 | 12/1977 | Ichikawa et al. | 355/315 |
| 4,198,155 | 4/1980 | Silverberg | 355/212 |
| 4,327,991 | 5/1982 | Takeuchi et al. | 355/315 |
| 4,616,920 | 10/1986 | Itoigawa et al. | 355/212 X |
| 4,627,702 | 12/1986 | Anderson | 355/212 |
| 4,992,834 | 2/1991 | Yamamoto et al. | 355/299 |
| 5,084,736 | 1/1992 | Suzuki et al. | 355/271 |
| 5,086,318 | 2/1992 | Takeda et al. | 355/315 X |
| 5,130,758 | 7/1992 | Takeda et al. | 355/315 |

*Primary Examiner*—Fred L. Braun

*Attorney, Agent, or Firm*—Fitzpatrick, Cella, Harper & Scinto

[57] ABSTRACT

An image forming apparatus includes a movable recording material carrying device having a flexible recording material carrying member for carrying a recording material; an image forming device for forming an image on the recording material carried on the recording material carrying member; a separator for separating the recording material from the recording material carrying member; and a connecting portion at a trailing edge of the recording material carrying member with respect to a movement direction of the recording material carrying member at a position, in a direction substantially perpendicular to a movement direction of the recording material carrying member, where the separator acts, the connecting portion covers a leading edge of the recording material carrying member.

18 Claims, 5 Drawing Sheets

IMAGE FORMING APPARATUS HAVING ENDLESS RECORDING MATERIAL CARRYING MEMBER

This application is a continuation of application Ser. No. 08/180,466, filed Jan. 12, 1994, now abandoned, which is a continuation of application Ser. No. 07/833,675, filed Feb. 11, 1992, now abandoned.

FIELD OF THE INVENTION AND RELATED ART

The present invention relates to an image forming apparatus such as an electrophotographic copying machine, printer, electrophotographic apparatus or electrostatic recording apparatus, having a flexible recording material carrying member, in which images are formed on the recording materials carried on the recording material carrying member.

In an image forming apparatus of an electrophotographic type, a toner image formed on an image bearing member in the form of a photosensitive drum, for example, is transferred onto a recording material in the form of a sheet of paper or the like.

In the case where plural toner images are superposedly transferred onto the same transfer material, a transfer material carrying member as shown in FIG. 7 is used which comprises opposingly disposed ring members 30 and 30 and a connecting member 31 connecting them to constitute a frame 32. As shown in FIG. 8, the recording material carrying member in the form of a flexible sheet 7 is bonded at the portions indicated by the hatching, so that a transfer drum 6 is constituted. The transfer material P is attracted and carried on the transfer material carrying sheet 7.

In a known transfer drum 6, as shown in FIGS. 9 and 10, one circumferential end portion, indicated by the hatching, of the carrying sheet 7 is fixed on the frame 32, and engaging members 33 mounted on the other circumferential end of the carrying sheet 7 is resiliently connected with the frame 32 through springs 34 and 34, by which the circumferential direction latitude of the carrying sheet 7 is provided by the swingable structure (transfer drum 6').

In the case where the transfer drum 6 or 6' is not provided with a gripper for gripping a leading edge of the transfer material, separating means shown in FIGS. 11–13 for separating the transfer material P from the carrying sheet 7 has been proposed, in which the carrying sheet 7 is locally deformed by the cooperation between the inside roller 1 and the pawl roller 2*a* mounted to an end of a separation pawl 2 (FIG. 12), and the separation pawl 2 is inserted between the carrying sheet 7 and the transfer material P, so that the transfer material P is separated from the carrying sheet 7. With this system, the leading edge of the transfer material can be retained on the carrying sheet 7, and therefore, the provision of the non-image area at the leading edge of the transfer material which is required in the case of the transfer drum with the transfer material gripper, is not necessary, and therefore, the image can be transferred onto the entire area of the transfer material.

However, the transfer drum involves a clearance X (FIGS. 8 and 10) at its leading and trailing edges in the movement direction thereof, when the carrying sheet constitute a cylindrical form. When the clearance X passes through the separating position, as shown in FIGS. 11–13, the leading end of the separating pawl 2 enters the clearance if the separating pawl approaches the carrying sheet 7 (FIG. 13), with the result of damage of the carrying sheet 7 and/or the separating pawl 2. In order to prevent this, it would be considered that the separating pawl 2 and the inside roller 1 are contacted to the carrying sheet 7 at the timing at which the clearance X passes through the separating position, by locating the leading edge of the transfer material P away from the carrying sheet 7 leading end. However, if this is done, the outer circumferential length of the transfer drum 6 or 6' is made larger than that of the maximum usable transfer material, or otherwise the size of the usable transfer material P is made smaller. Therefore, it is not avoidable to increase the size of the apparatus or accept the poor operativity.

SUMMARY OF THE INVENTION

Accordingly, it is a principal object of the present invention to provide an image forming apparatus in which a recording material carrying member or a separating member for separating a recording material from the recording material carrying member is protected from damage.

It is another object of the present invention to provide an image forming apparatus in which the operational latitude of the separating means is expanded.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, embodiments of the present invention will be described.

Figure 6:
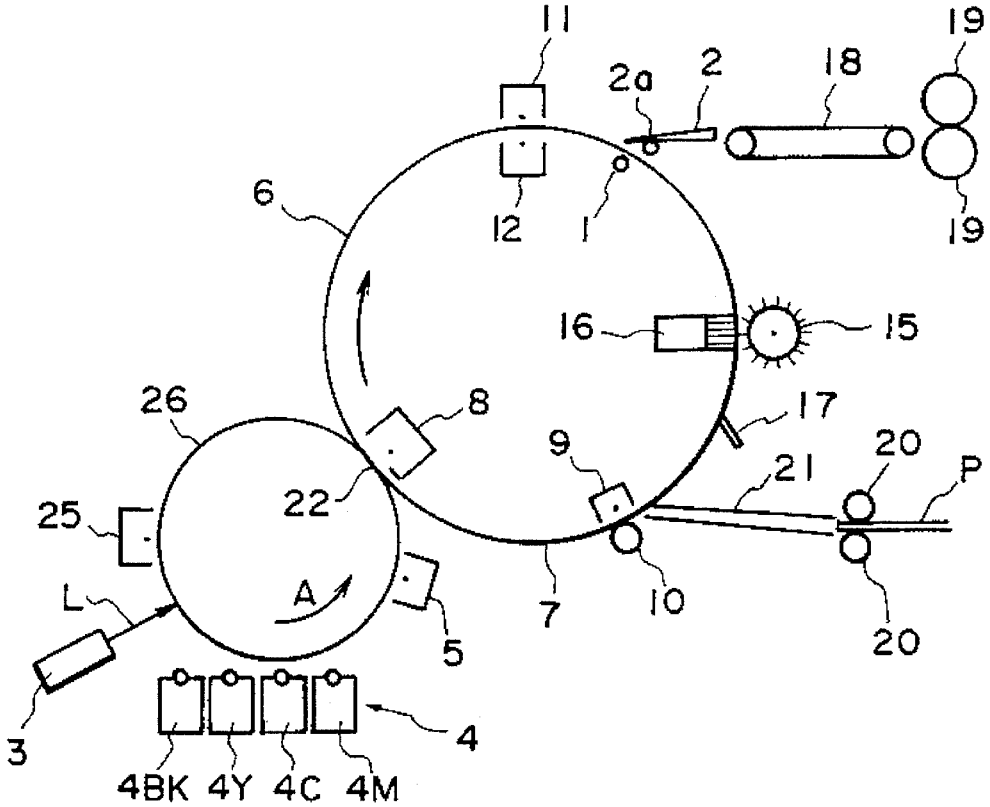
FIG. 6 is a side view of an image forming apparatus according to an embodiment of the present invention.

Referring to FIG. 6, there is shown a color image forming apparatus as an exemplary image forming apparatus according to an embodiment of the present invention. An image bearing member in the form of a photosensitive drum 26 is supported at its rotational center and is rotated in a direction indicated by an arrow A. Around the outer circumferential surface of the photosensitive drum 26, there are disposed a primary charger 25, an optical system 3, a developer supplying device 4 and a secondary charger 5 in the order named. The primary charger 25 functions to uniformly charge the photosensitive drum 26. The optical system 3 functions to project light image or light beam corresponding to the light image of a color separated image onto a surface of the photosensitive drum 26 having been subjected to the operation of the primary charger 25, at proper timing, so that an electrostatic latent image is formed on the photosensitive drum 26. In this embodiment, the optical system 3 comprises a laser beam exposure device. The developer supplying device 4 is movable in a tangential direction of the surface of the photosensitive drum 26. It comprises four developing devices 4M, 4C, 4Y and 4BK containing magenta developer, cyan developer, yellow developer and black developer (toner), respectively. The developer supplying device 4 faces one of the developing devices that correspond to the color of the light image or the corresponding beam L to the photosensitive drum 26, and the toner electrostatically jumps to the surface of the photosensitive drum 26, thus developing the electrostatic latent image thereon.

Figure 7:
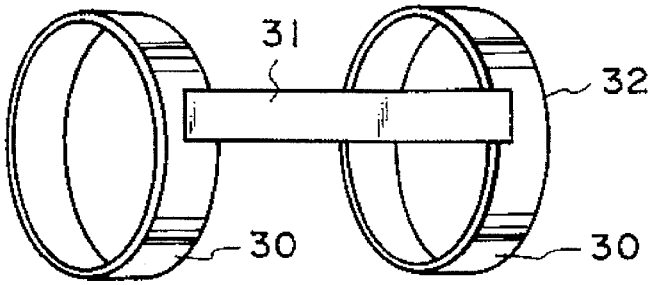
FIG. 7 is a perspective view of a frame of a transfer drum functioning as the recording material carrying means.
Figure 8:
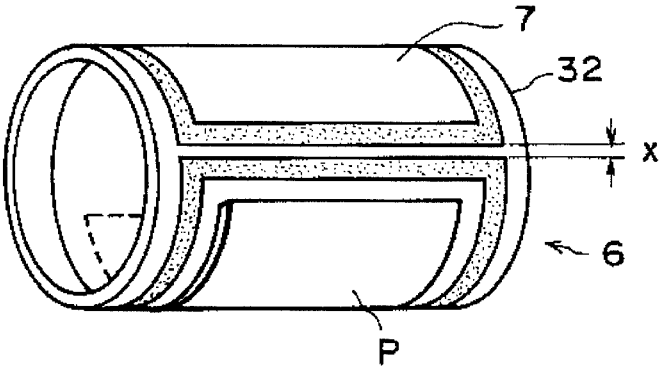
FIG. 8 is a perspective view of a transfer drum functioning as the recording material carrying means.

Downstream of the developing device with respect to the rotational movement direction of the photosensitive drum 26, a recording material carrying means in the form of a transfer drum 6 is faced with a small clearance to or contacted to the surface of the photosensitive drum 26 surface. The transfer drum 6 is not provided with any gripper, and comprises opposing ring members 30 and 30 and a connecting member or stay 31 for connecting them, as shown in FIG. 7. These members constitute a rigid supporting frame. The circumferential opening portion defined by the frame is covered with a flexible carrying sheet 7 in a cylindrical form. Adjacent the side of the carrying sheet 7 away from the photosensitive drum 26, there is disposed a transfer corona charger 8 for transferring the toner image from the photosensitive drum 26 to the recording material in the form of a transfer material sheet. Thus, the means for forming an image on the recording material comprises the photosensitive drum 26, the primary charger 25, the optical system 3, the developer supplying device 4 (process means) and a transfer corona charger 8.

Upstream of the transfer position with respect to the rotational direction of the transfer drum 6, there are an attraction corona discharger 9 functioning as an attraction means for electrostatically attracting the transfer material onto the carrying sheet 7, and an electrically conductive roller 10 which is grounded. They are opposed to each other, The transfer material P is guided to the attracting position along a guide 21 through the nip between the conveying rollers 20 and 20, from an unshown sheet supplying station. The transfer material P is first attracted and retained on the carrying sheet 7 of the transfer drum by the attracting means. The transfer material P carried on the carrying sheet 7 is fed by rotational movement of the transfer drum 7 to a transfer position 22 where the transfer corona charger 8 is opposed to the photosensitive drum 26, by which the four color toner images are superposedly transferred from the photosensitive drum 26 to the transfer material P, one by one. Downstream of the transfer position, corona dischargers 11 and 12 are provided sandwiching the carrying sheet 7 for electrically discharging it. Adjacent it, there are separating pawls 2 (separating means), inside deformation roller 1 and an outside deformation roller 2*a*. Further downstream, there are a brush roller 15 for cleaning the transfer material carrying surface of the carrying sheet 7, a brush 17 and a scraper 17 for cleaning the non-image region of the surface of the carrying sheet.

Figure 11:
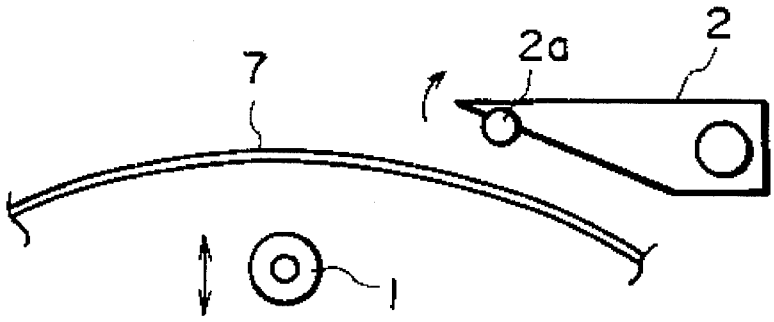
FIG. 11 is a sectional view of a separating portion of the transfer drum.
Figure 12:
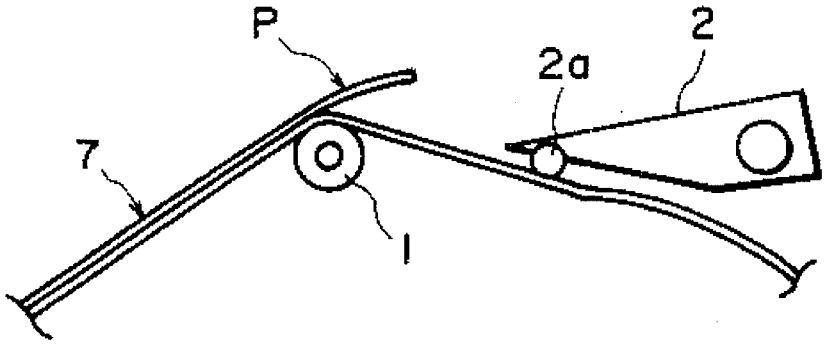
FIG. 12 is a sectional view of a separating portion of the transfer drum.
Figure 13:
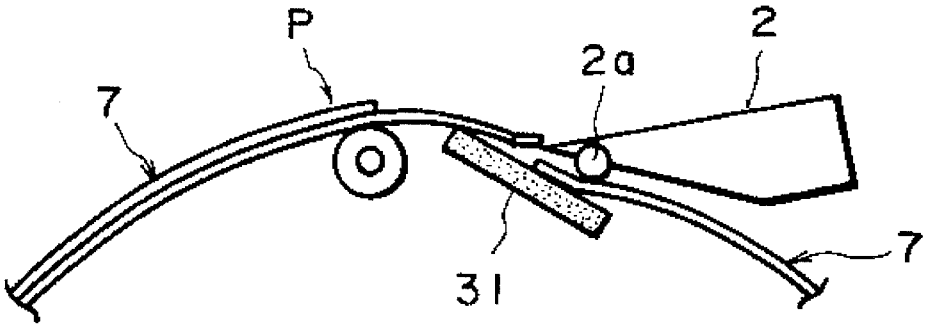
FIG. 13 is a sectional view of a separating portion of the transfer drum.

After the image transfer operation, the transfer material P electrically discharged by the corona dischargers 11 and 12, as shown in FIG. 11 and 12, is separated from the carrying sheet by the separating pawl 2 provided at the transfer material carrying side of the carrying sheet 7 while the carrying sheet 7 is being deformed by the inside and outside rollers 1 and 2*a* (deforming means).

The separated transfer material P is supplied to the heat fixing roller 19 by a conveyer 18, where the superposed toner are heated and mixed into a fixed full-color image.

Figure 1:
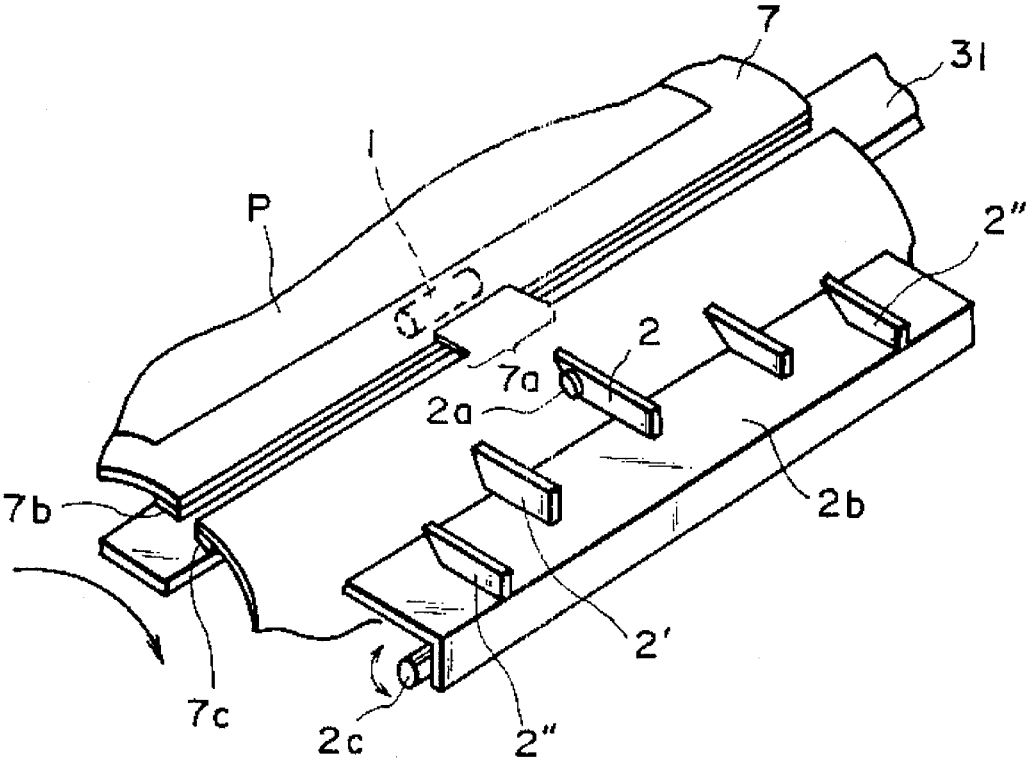
FIG. 1 is a perspective view of a major part of a recording material carrying means usable with an image forming apparatus according to an embodiment of the present invention.

Referring to FIG. 1, the transfer drum (recording material carrying means) will be described. As shown in FIG. 1, the leading and trailing edges of the carrying sheet 7 with respect to the rotational movement direction of the photosensitive drum 6 are mounted to the connecting member 31 through urethane foam materials 7*b* and 7*c*. A first separating pawl 2 (separating member) is disposed at the longitudinal center. Auxiliary separation pawls, i.e., second and third separation pawls 2' and 2" are disposed in a sector fashion toward the downstream of the movement direction of the transfer drum 6, by which only the first separating pawl 2 is contactable to the carrying sheet 7, as will be readily understood from FIG. 1.

Adjacent the end of the first separation pawl, it rotatably supports an external deformation roller 2*a*. The trailing edge of the retaining sheet 7 is provided with a connecting portion 7*a* in a side having the separating pawl 2 at a position where the first separating pawl acts on the transfer material carrying sheet, that is, the position where the external deformation roller 2*a* and the internal deformation roller 1 constitute a nip, in the generating line direction of the transfer drum 6 (the direction substantially perpendicular to the movement direction of the surface of the transfer drum). The connecting portion 7*a* is overlaid on the trailing edge portion of the carrying sheet 7 so as to cover it. The first, second and third separating pawls 2, 2' and 2" are supported on a separating pawl supporting member 2*b*, which is rotatable about a shaft 2*c*.

The carrying sheet 7 supports the transfer material P so that the leading edge thereof is positioned adjacent to and downstream of the connecting member 31.

With the above structure, immediately before the leading edge of the transfer material P on the carrying sheet 7 reaches the separating position, the separating pawl supporting member 2*b* is rotated in the counterclockwise direction about the shaft 2*c* by an unshown driving means to a separation operating position. Then, as shown in FIG. 12, the external deformation roller 2*a* is pressed to the carrying sheet so as to deform it, and the inside deformation roller 1 also deforms the carrying sheet 7. First, the edge of the first separation pawl 2 enters between the carrying sheet 7 and the leading edge of the transfer material P at the insertion point. When the leading edge of the transfer material P starts to separate from the carrying sheet, the second and third separating pawls 2' and 2" are gradually inserted between the carrying sheet 7 and the transfer material P.

With the further rotation of the transfer drum 6, the transfer material P is completely separated from the carrying sheet 7. After the separation, the separation pawl supporting member 2*b* is rotated clockwisely about the shaft 2*c* to its inoperative position, so that the separation pawl 2, outside deformation roller 2*a*, and the inside deformation roller 1 are separated from the carrying sheet 7.

In the generating line direction of the transfer drum 6, the central position where the first separating pawl 2, the outside deformation roller 2*a* and the inside deformation roller 1 are disposed, is a reference position for the transfer material P. That is, the transfer material P is supplied with its center aligned with the reference position irrespective of the sizes of the transfer material P.

Since the connecting portion 7*a* of the carrying sheet 7 is at the same side as the separating pawl acts at a position where the separating pawl 2 acts, in the direction of the generating line of the transfer drum 6, the separating pawl 2 is prevented from entering the clearance between the frame and the leading edge of the carrying sheet and between the frame and the trailing edge thereof. Therefore, the damage or deformation of the separating pawl 2 is effectively prevented.

Figure 2:
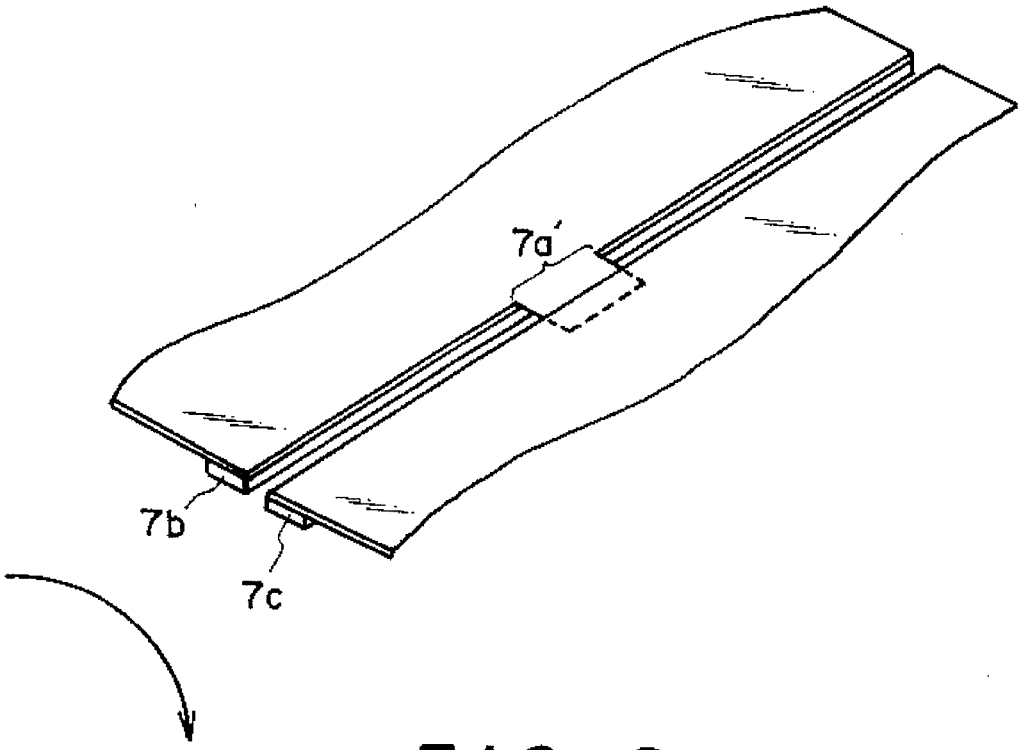
FIG. 2 is a perspective view of a major part of a recording material carrying member usable with an image forming apparatus according to another embodiment of the present invention.
Figure 3:
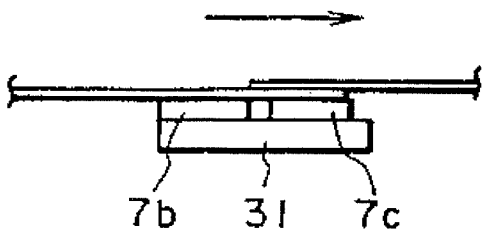
FIG. 3 is a sectional side view of the apparatus of FIG. 2.
Figure 4:
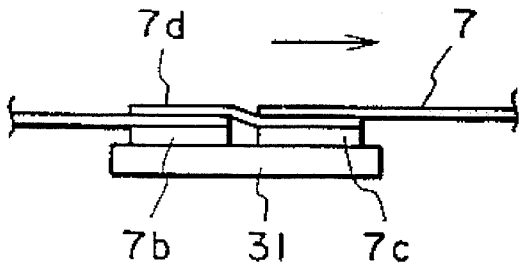
FIG. 4 is a sectional side view of a recording material carrying member usable with an image forming apparatus according to a further embodiment of the present invention.

In addition, it is possible to move the separating pawl to the operating position before the trailing edge of the carrying sheet 7 passes through the separating position. Therefore, the operational latitude of the separating timing is increased. Since the leading edge of the carrying sheet 7 and the leading edge of the transfer material P carried on the carrying sheet 7 are close to each other, the size of the transfer drum 6 can be reduced. The circumferential of the transfer drum 6 excluding the connecting member 31 may be made equal to the maximum usable size of the transfer material. In this embodiment, as shown in FIG. 1, the connecting portion 7*a* is provided at the trailing edge of the carrying sheet 7, and it is overlaid on the leading end portion of the carrying sheet 7. However, the connecting portion may be provided at the leading edge of the carrying sheet 7 and is placed under the trailing edge portion thereof, as shown in FIGS. 2 and 3 (7*a*') if the connecting portion is adjacent the separating pawl 2 acting position and at a generating line direction position where the separating pawl 2 acts. It is another alternative that additional sheet 7*d* is bonded, as shown in FIG. 4.

Figure 9:
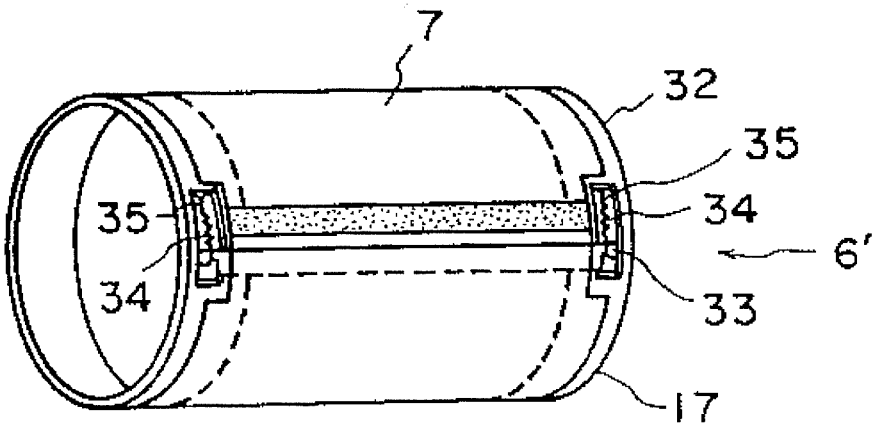
FIG. 9 PRIOR ART
FIG. 9 is a perspective view of a transfer drum as a conventional recording material carrying member.
Figure 10:
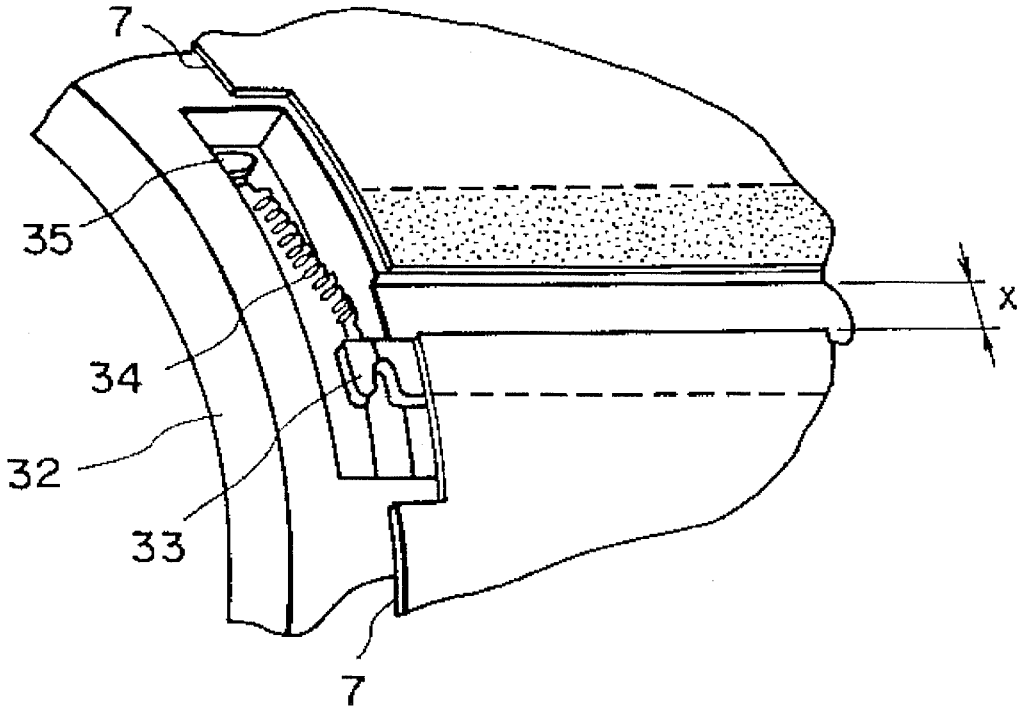
FIG. 10 PRIOR ART
FIG. 10 is an enlarged perspective view of the engaging portion between the carrying sheet and a frame of FIG. 9.

In FIG. 1, the edges of the carrying sheet 7 are fixed on the connecting member 31 through the urethane foam materials 7*b* and 7*c*. However, as shown in FIGS. 9 and 10, it is an alternative that the leading edge of the carrying sheet 7 is fixed on the connecting member 31, whereas the trailing edge is pulled by a spring 34 toward the leading edge. In this case, the above-described connecting portion is effective, similarly. However, in this case, since the trailing edge is movable toward the downstream with respect to the rotational direction, the connecting portion is desirably larger than in the both ends fixed structure (FIG. 1) in the movement direction. However, according to this embodiment, as contrasted to the case wherein the carrying sheet is fixed on the frame by the bonding, it is advantageous in the easiness of the wrapping operation of the retaining sheet on the frame, and in the prevention of improper image transfer attributable to the slackness of the carrying sheet due to the temperature change.

In another fixing method for fixing the carrying sheet 7 on the frame, the edges of the carrying sheet are bonded together at portions where they are overlaid and supported on the ring members 30.

In the foregoing embodiments, the connecting portion is formed only at a position corresponding to the first separating pawl. It may be provided also at the position or positions corresponding to the separating pawl 2' and/or 2". In addition, it may be extended over the entire length of the carrying sheet 7 in the direction of the generating line.

Figure 5:
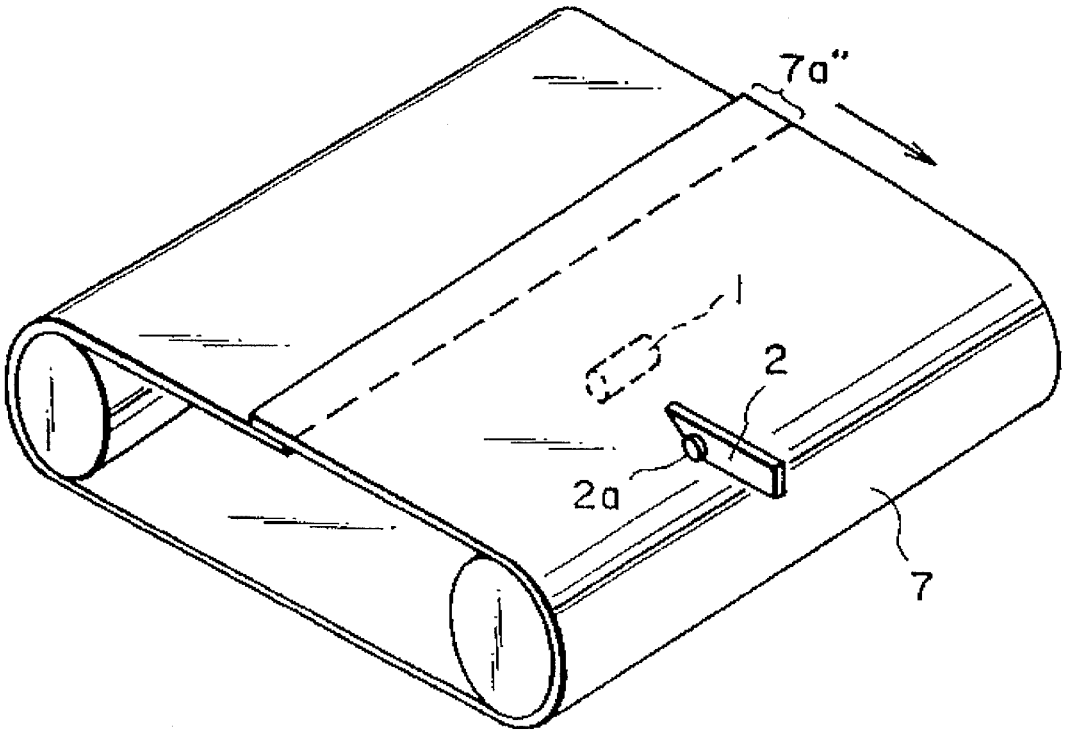
FIG. 5 is a perspective view of a recording material carrying means usable with an image forming apparatus according to a further embodiment of the present invention.

In the foregoing embodiments, the transfer material carrying means 6 has been in the form of a drum. However, it may be in the form of a belt conveyer as shown in FIG. 5. In this case, the leading and trailing edges are directly bonded at the connecting portion 7*a*". In this case, the structure is simplified. In this case, too, similarly to the foregoing embodiments, the position where the leading edge of the transfer material P is carried on the carrying sheet 7 is slightly downstream of the neighborhood of the connecting portion 7*a*", and the outside and inside deformation rollers 2*a* and 1 function in the same manner.

In place of the photosensitive drum 26, an ink jet recording head is usable, by which the image is directly formed by the recording head on the recording material carried on the recording material carrying means in the form of a belt, for example.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable recording material carrying means having a flexible recording material carrying member, having leading and trailing ends, for carrying a recording material;

image forming means for forming an image on the recording material carried on said recording material carrying member;

separating means for separating the recording material from said recording material carrying member at a separating position, said separating means including a separating member insertable between the recording material and said recording material carrying member, wherein said separating member is movable between a first position for performing a separating action and a second position for not performing the separating action, the second position being more distant from said recording material carrying member than is the first position;

a connecting portion for connecting the leading and trailing ends of said recording material carrying member, disposed at least at such an insertion position that said separating member is inserted between the recording material and said recording material carrying member, said connecting portion covering the leading end of said recording material carrying member, wherein the recording material is supported so as to avoid the connecting portion on said recording material carrying member, and wherein the leading end of the recording material is carried a predetermined distance away from said connecting portion with respect to the movement direction of said recording material carrying member, and wherein when said separating member performs the separating action, said separating member is moved from said second position to said first position before the trailing end of said recording material carrying member reaches the separating position.

2. An apparatus according to claim 1, wherein said recording material carrying member is in the form of a sheet, and said connecting portion is in the form of a sheet.

3. An apparatus according to claim 1 or 2, wherein said separating means includes a separation pawl.

4. An apparatus according to claim 1 or 2, wherein said recording material carrying means includes opposingly disposed ring portions, a stay for connecting the ring portions, wherein said recording material carrying member covers a cylindrical opening defined by the ring portions and the stay.

5. An apparatus according to claim 4, wherein said connecting portion is fixed to said stay.

6. An apparatus according to claim 1, wherein said separating means includes a deforming member for deforming the recording material carrying member when said separating means operates.

7. An apparatus according to claim 6, wherein said deforming member is adjacent a recording material carrying face of said recording material carrying member.

8. An apparatus according to claim 6, wherein said deforming member comprises a first deforming member disposed adjacent a recording material carrying side of said recording material carrying member and a second deforming member adjacent an opposite face of said recording material carrying member.

9. An apparatus according to claim 1, wherein said image forming means includes an image bearing member and transfer means for transferring an image from said image bearing member to the recording material.

10. An apparatus according to claim 9, wherein plural images can be formed on said image bearing member, and the images are transferred onto the recording material superposedly and one by one.

11. An apparatus according to claim 10, wherein said apparatus is capable of forming a full-color image on the recording material.

12. An apparatus according to claim 9, wherein said connecting portion is at a reference position for the recording material supply to said recording material carrying means.

13. An apparatus according to claim 1, further comprising attracting means for electrostatically attracting the recording material on said recording material carrying member.

14. An apparatus according to claim 1, wherein said connecting portion is provided integrally with said recording material carrying member.

15. An apparatus according to claim 1, wherein said recording material carrying member is capable of carrying the recording material such that a leading end of the recording material is close to the leading end of said recording material carrying member.

16. An apparatus according to claim 1, wherein the ends of said recording material carrying member are connected only at said insertion position.

17. An apparatus according to claim 1, wherein said separating means includes an auxiliary member insertable between the recording material and said recording material carrying member after insertion of said separating member therebetween.

18. An apparatus according to claim 1, wherein said separating member has a tapering end.

* * * * *